United States Patent [19]

Rehm et al.

[11] 4,415,205

[45] Nov. 15, 1983

[54] TRIPLE BRANCH COMPLETION WITH SEPARATE DRILLING AND COMPLETION TEMPLATES

[76] Inventors: William A. Rehm, 12558 Westerly La.; Donald W. Dareing, 13914 Jaycreek Crt., both of Houston, Tex. 77070; Edward T. Wood, 3415 Fawn Creek, Kingwood, Tex. 77339

[21] Appl. No.: 282,210

[22] Filed: Jul. 10, 1981

[51] Int. Cl.[3] ..... E21B 43/28; E21B 29/06

[52] U.S. Cl. ..... 299/5; 166/50; 166/117.5; 175/61

[58] Field of Search ..... 166/50, 117.5; 299/4, 299/5; 175/61

[56] References Cited

U.S. PATENT DOCUMENTS

| | | | |
|---|---|---|---|
| 2,211,803 | 8/1940 | Warburton | 166/117.6 X |
| 2,797,893 | 7/1957 | McCune et al. | 166/117.5 X |
| 2,858,107 | 10/1958 | Colmerauer | 166/117.6 X |
| 4,222,611 | 9/1980 | Larson et al. | 299/5 X |

OTHER PUBLICATIONS

Dareing et al "Drilling & Completing Multiple Branched Boreholes for in situ leach mining" 10/1/81 A.S.M.E.

*Primary Examiner*—Ernest R. Purser
*Attorney, Agent, or Firm*—Thomas Zack

[57] ABSTRACT

A method, and apparatus to practice the method, to complete multiple (triple) branch wells using separate drill and casing templates. Principally this invention finds its greatest utility in the in situ leach mining of deep lying ore bodies. Initially, a generally vertical main hole is drilled in the earth and cased. The particular casing used has an internal indexing dog and specific areas which act as windows from which some of the branch wells are to be drilled. To form the individual branch wells, each window is sequentially drilled out by a drilling assembly which is oriented by a movable drilling template. The template is fixed with respect to the casing for each branch drilling by engaging the indexing dog. After each window and branch well is drilled, the drilling assembly and drilling template are retrieved to the surface and repositioned with respect to each other to provide for the next branch drilling. A whipstock assembly is used in connection with the drilling template and indexing dog to positively locate each branch well. After all branch wells are drilled, the whipstock assembly is retrieved. Next a triple tubing guide or template, which can engage the same indexing dog, is used to simultaneously position branch casings in each of the previously drilled branch holes. A tubing hanger is used to position and hold these casings within the main casing. Cement baskets are attached to the shoe (end) of each branch casing and all casings are cemented in place. Lastly, the branch wells may be perforated, unless this has been done in the casing production process, and the well is then ready for production.

6 Claims, 6 Drawing Figures

TRIPLE BRANCH COMPLETION WITH SEPARATE DRILLING AND COMPLETION TEMPLATES

BACKGROUND OF THE INVENTION

1. Field of the Invention

A method, and the apparatus to practice the method, used to drill multiple branch wells from a main generally vertical cased hole.

2. Description of the Prior Art

The invention described herein relates to work done by Maurer Engineering Inc. and Completion Technology Company under contract and subcontract, respectively, with the United States Department of the Interior, Bureau of Mines. Three other inventions also resulted from the work under this same contract. These are the copending patent applications entitled: "Method for Completing Horizontal Drain Holes," by Edward T. Wood et al bearing Ser. No. 276,609, filed Sept. 10, 1981; "Multiple Branch Well Containing One Producer and One Injector Well," by Edward T. Wood et al bearing Ser. No. 276,552, filed June 23, 1981, and "Multiple Branch Completion with Common Drilling and Casing Template," by Edward T. Wood et al bearing Ser. No. 276,551, filed June 23, 1981. There are also two related patents concerned with branch wells and in situ leach mining to wit: U.S. Pat. No. 4,222,611 entitled "In-Situ Leach Mining Method Using Branched Single Well for Input and Output," by W. C. Larson et al and U.S. Pat. No. 4,249,777 entitled "Method of In-Situ Leach Mining," by W. C. Larson et al.

The closest known invention to what is being disclosed and claimed herein is the cited patent application to Edward T. Wood (one of the coinventors herein) et al entitled "Multiple Branch Completion with Common Drilling and Casing Template" (hereinafter referred to as the closest invention). Its contents are specifically incorporated by reference herein. As indicated therein, the contents of that and this invention was first made available to the public in an ASME publication 81-PET-2 entitled "Drilling and Completing Multiple Branched Boreholes for In Situ Leach Mining" distributed on Jan. 18–22, 1981.

The essential similarities between this invention and the invention referred to as being closest can be found in several aspects. Each is concerned with a method of forming multiple branch wells from a main generally vertical cased hole for primary use with in situ leach mining. And each employs whipstocks and a drilling template which engages an indexing dog to properly orient the drilling assembly with respect to the main casing to allow drilling of the branch wells. There are also several important differences between these same two inventions. In this invention, the main casing has at least one easily-penetrated exit points or windows, in its side, corresponding to the beginning point for at least one of the multiple branches to be constructed. Herein there is both a drilling template and a tubing template which are engaged by the indexing dog to orient the drilling assembly or casing tubes, respectively. Further, in this invention, the templates are mounted vertically to form and engage at least one of the branch wells that are formed through the main casing. None of these features are present in the closest invention. As a result, this invention allows a smaller main casing (9⅝" O.D.) to be used with three smaller branch casings (each of 3" O.D.). This in turn means less cost to set up the well system for production in a shorter time.

SUMMARY OF THE INVENTION

Initially the main generally vertical hole is drilled, cased, and cemented. The casing used has at least one easily-penetrated exit point which constitutes a window for a branch well. Also within this same casing is a member fixed therein that acts as an indexing dog. Its purpose is to form a fixed reference. The next step is to insert a drilling assembly and drill out the bottom or shoe of the main casing. Using this drill to drill the earth, the first branch well hole is constructed in a vertical direction. Then the drilling assembly is retrieved to the surface and fitted with a whipstock assembly. This whipstock assembly includes a drilling template and whipstock and along with a drilling assembly is lowered into the hole to the level of the at least one window and rotated (muleshoed) to engage the internal indexing dog. Thereafter, a branch well hole is drilled through the casing's window and into the surrounding earth to the desired depth. If more than one window is involved, which is the usual case, the whipstock and drilling assembly are retrieved to the surface and adjusted to allow for the drilling for the next branch hole through its window. Following the drilling of all branch wells through their individual windows, a tubing template is inserted into the casing. This template engages the indexing dog, as did the drilling template, to orient the casing tubes towards their respective previously drilled branch holes. All casings are simultaneously positioned by the template and then inserted into their respective branch holes. After cementing and perforating, if necessary, the branch casings, these wells are ready to act as either recovery or injector wells for the leachant solution.

The primary object of this invention is an improved method, and the apparatus to practice the method, to complete multiple branch wells from a main generally vertical well.

DESCRIPTION OF THE PREFERRED EMBODIMENT

The subject matter of this invention, as well as several of the inventions mentioned in the discussion of the prior art, was prompted by a desire to apply oil and gas drilling techniques to in situ leach mining of minerals. More specifically we sought to use directional drilling techniques to form branch wells which would function as either injection or producer wells. The preferred embodiment disclosed and illustrated herein is an injector well, it being understood that with a slight modification, for example using recovery pumps, etc., it could function as a producer or recovery well. Both types are included within the scope of this invention. Also, these injector and producer wells can be drilled in a series of five spot patterns developed by alternate parallel rows of producer and injector wells. The mentioned U.S. Pat. No. 4,249,777 by W. C. Larson et al discloses such a drilling pattern.

Figure 1:
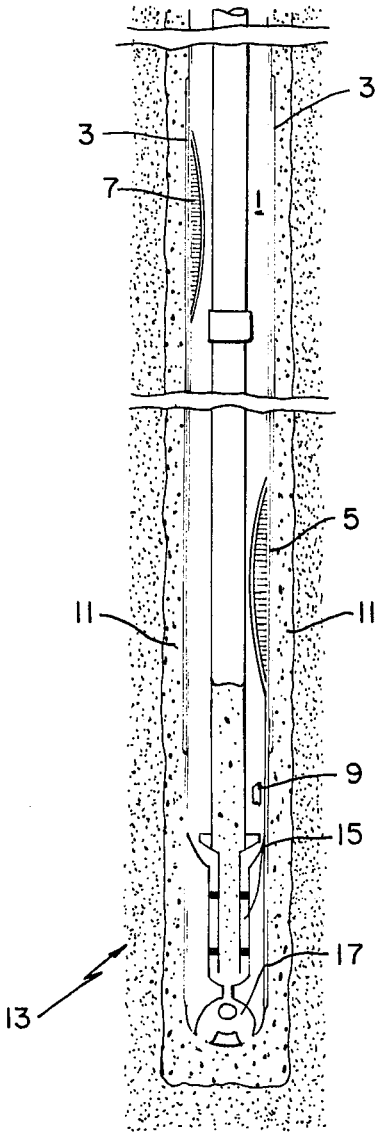
FIG. 1 schematically illustrates the preferred embodiment of the invention after the main well casing has been cemented in place.

Conventional techniques are used to drill the main vertical hole 1 shown in FIG. 1. Since this invention will find its primary—but not sole—applicability in deep lying in situ leach mining of minerals, the depth of the hole is typically about 2,000 feet below the surface. Next, a special casing 3 is inserted into the drilled hole an appropriate distance above the ore body. This casing is special in that it has a series of vertically separated windows 5 and 7, or easily-penetrated exit points, with one window corresponding to the desired location of the opening for a branch well, and an internal indexing dog 9. In our preferred embodiment, the casing was a $9\frac{5}{8}$ inch O.D. steel casing and its windows were fiberglass-filled windows. The indexing dog is used to positively locate each branch well opening relative to the fixed main casing. Essentially, it consists of a protrusion, or male part, which engages an opening in a template.

Between the earth's surface defining the hole 1 and the outer surface of the casing 3, cement 11 is injected. This cementing step (FIG. 1) is conventional and makes use of a bottom joint having a prefabricated float assembly 13 and seal bore 15 for inner string or stab in cementing. The float assembly contains a check valve 17 which prevents fluid entry as the casing string is run, to increase its bouyancy, and to prevent cement 11 return to the inside of the casing. After pumping the desired volume of cement, the inner string is lifted from seal bore 15 and any cement remaining in the inner string is displaced back to surface by the commonly known method of reverse circulation.

Figure 2:
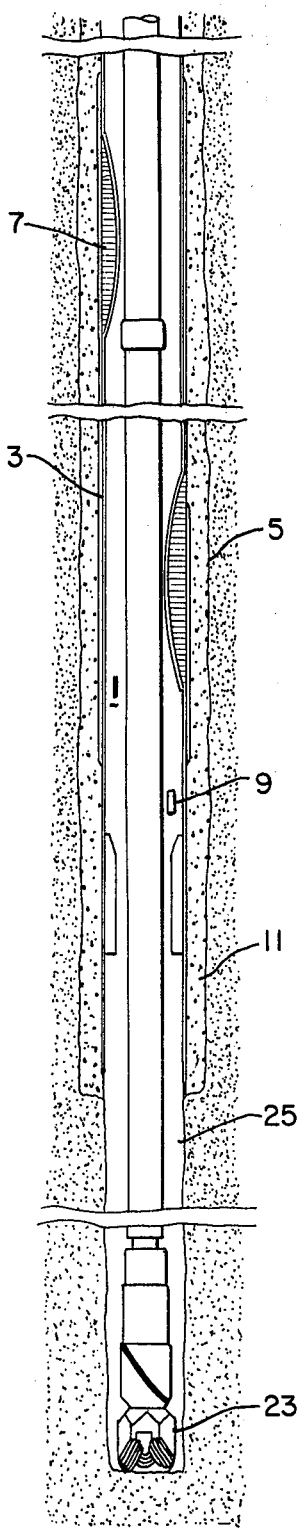
FIG. 2 shows the FIG. 1 embodiment with the drilling assembly therein after the first branch well hole has been drilled.

FIG. 2 shows the next step in the preferred embodiment of the method used to practice our invention. In this figure, a drilling assembly 23 is used to drill the first branch well. This branch 25 is drilled through the cement in the bottom of the main casing. It extends in a generally vertical direction into the ore zone whose minerals are to be recovered.

Figure 3:
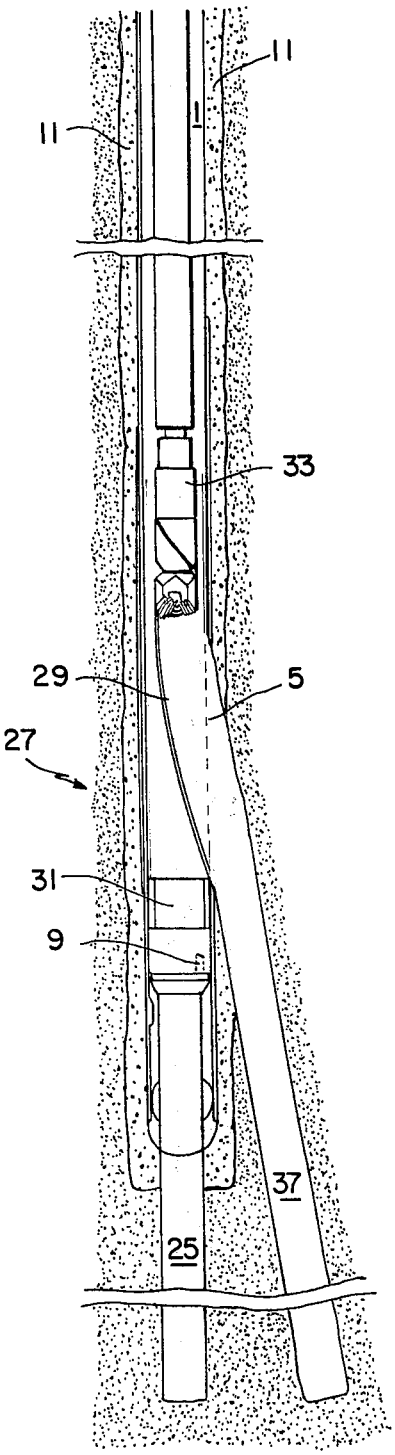
FIG. 3 depicts the FIG. 2 embodiment after the second branch well is drilled.

The second branch well is drilled as depicted in FIG. 3. In this case, a whipstock assembly 27 is run in the protection casing to a height opposite the lower window 5 and then rotated to seat on the internal indexing dog. This assembly consists of the whipstock 29 and a drilling template 31. This drilling template is basically a plurality of small circular collars, with one collar corresponding to each branch to be drilled, encircled by a larger circular collar which touches the inner surface of the main casing 3. FIG. 2 of the closest invention shows such an arrangement. This allows the whipstock to guide the directional drilling assembly 33 through the premilled fiberglass window 5 located near the bottom of the protection casing. Once this is done to the proper depth, the second branch 37 is drilled to its appropriate depth by the assembly 33 after the drill is returned to the surface and placed in its corresponding template smaller collar. Last, after each branch is drilled to their proper depth, the drilling assembly and whipstock assembly is pulled and retrieved via a wireline or some other type of pulling assembly (not shown).

Figure 4:
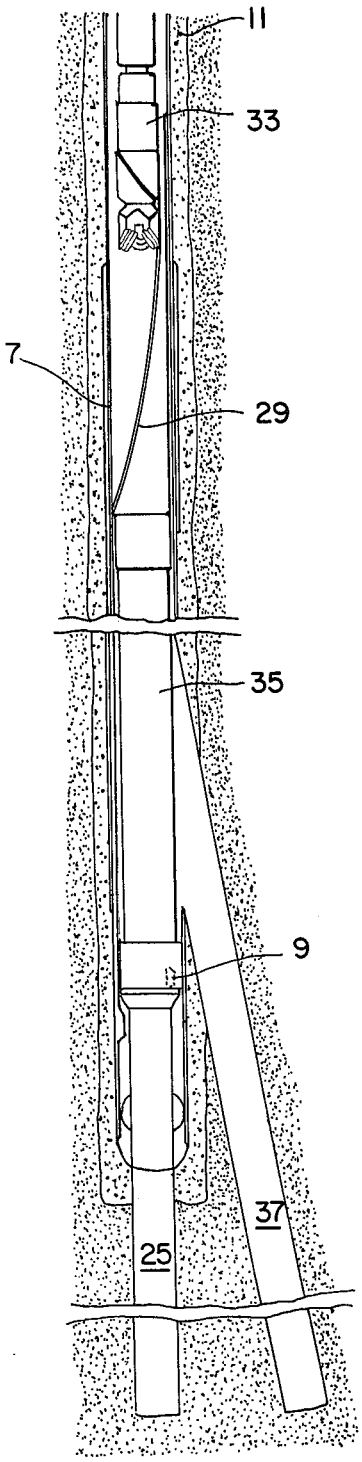
FIG. 4 shows the FIG. 3 set up as the third branch well is starting to be drilled.

In order to drill the third branch, the whipstock assembly is modified to guide the directional drilling assembly into the upper window of the casing (see FIG. 4). This modification consists of the addition of the whipstock extension 35 which raises the whipstock 29 to its proper height opposite this second window 7. As before, the drill is placed in the proper template small collar at the surface and then the whipstock assembly 27 is run in the hole with a running assembly. Once at the proper height, the drilling template is rotated to engage with the internal indexing dog. This causes the whipstock and drilling assembly to face in the desired direction towards the second upper premilled window. As before, the branch is drilled to its appropriate depth through this window to form the third branch well 39. Thereafter, the drilling assembly and whipstock are retrieved to the surface.

Figure 5:
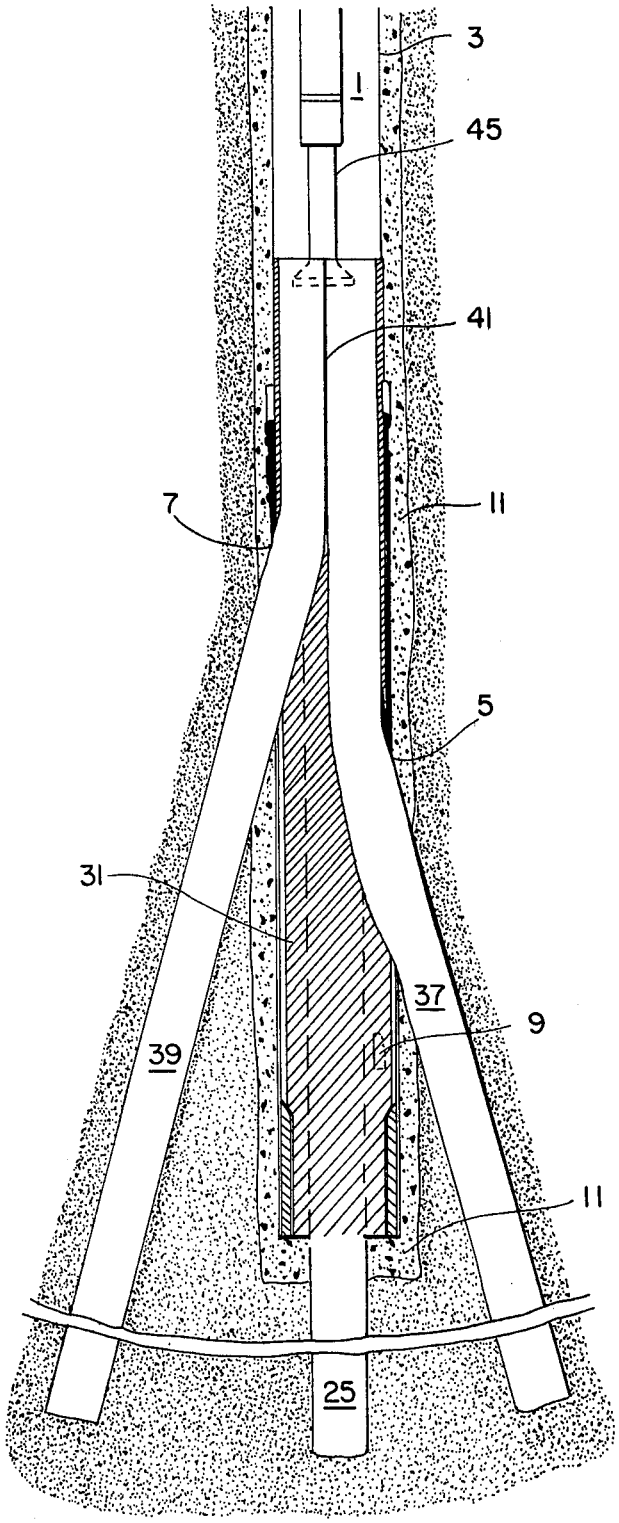
FIG. 5 shows the next step of installing the tubing guide or template after all branch wells have been drilled.

In FIG. 5, a triple tubing guide 41 is installed in the next sequential step. Like the drilling template, this tubing guide or template utilizes the same internal indexing dog fixed to the casing to properly orientate it. It too is a plurality of small circular collars within a larger circular collar with each smaller collar acting as a directional guide for the tubular casing which can move therethrough. This will allow three flexible branch casing strings to be placed in these collars and guided into their respective branch well holes. These three casings along with a triple tubing hanger 43 (FIG. 6) are simultaneously run into the main casing by assembly 45 and then the branch casings, as the case may be. These branch casings may be made of a flexible fiberglass pipe or tubing material as in the closest invention which provides the necessary flexibility and strength thereto. The running assembly 45 is used to lower the tubing guide 41 into the hole and orient the guide onto the indexing dog. It is then retrieved. The triple tubing hanger 43 and three fiberglass tubes (49, 51, 53) are lowered with three vertical metal tubes (not shown) which screw into the tubing hanger. Cement is pumped through the metal tubes and down through the fiberglass tube, in the branches and forced around the fiberglass tube, up to the tubing hanger. The metal tubes are then retrieved. Three additional fiberglass tubes (55, 57, and another, not shown) are then lowered into the hole and screwed into the upper portion of the tubing hanger.

Figure 6:
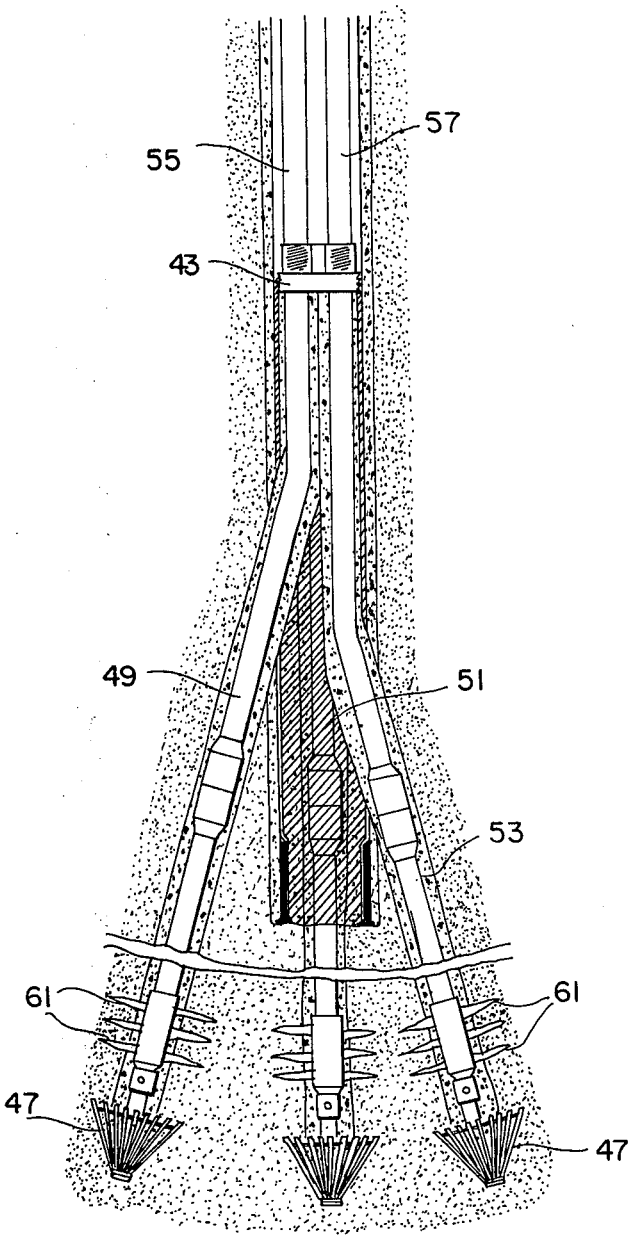
FIG. 6 is the completed well with all of its branch wells after it has been cased, cemented, and perforated and in place and is ready to receive the leachant solution.

As shown in FIG. 6, cementing basket-like anchoring devices 47 or any other rugged mechanical anchor may be attached to the shoe of each of the branch casing to prevent the fiberglass from floating as heavy cement is circulated into the annulus volume between the casing and surface forming the branch holes. The top of the tubing guide orients the three casing strings into the branches. Once in place, the cement is reversed out above the hanger. Unless, perforated in production, the three lower branches are perforated (61) with a water jet or some other device and the well of FIG. 6 is ready for injection of the leachant solution.

As pointed out previously, one of the advantages of this invention is the cost and time saving attributed to the use of a smaller diameter main casing and smaller diameter branch casings. In one embodiment, the main casing is a $9\frac{5}{8}$ inch O.D. casing and each of the branch casings are 3 inches O.D. This main casing must be in good condition to allow the tubing guide to be installed because the outside diameter of the guide takes up just about all of the inside diameter of the casing allowing only minimum clearance. These are standard oil field drilling casing (except for the window and indexing dog) and higher grade casing is available for applications down to 5,000 feet below the surface. The fiberglass windows in the casing should be strong enough to withstand the pressures subjected to without breaking until drilled. At greater depths, these precut windows could be replaced by a mill cut in the casing which would provide more strength and yet allow the casing to be more easily penetrated at this particular location.

The most critical phase of the method taught by our invention is the installation of the three strings of fiberglass branch casings. The open branch holes of each of the three branches must have sufficient integrity not to cave or collapse while subsequent branches are drilled, before or while the branch casings are being installed, or before the cement is installed.

The templates used to orient the drill for the branch holes and the tubing guide both engage the casing's internal indexing dog. In its simplest form, this indexing dog can be a small protruding plate welded to the inside of the main well bore casing. It is positioned so as not to interfer with drill bit entry into any of the three branches. The templates are essentially large collars encircling smaller curved tabular collars. Both templates can move vertically in the main casing and have a lower cut, hole or indentation on the bottom side of the large collar to engage the dog and thereby form a fixed reference orientation with respect thereto. The whipstock is a curved steel member (see FIGS. 3 and 4) which forms part of the small collar of the drilling template. It functions to force the directional drilling assembly to change its direction towards the casing windows.

It should be very apparent that our invention is not limited to the specific embodiment. Other uses beside in situ leach mining are also possible. These include oil and gas recovery, reservoir monitoring, including any type of operation where multiple branch holes are to be drilled in the earth. None of these variations should be used to restrict or otherwise change the scope and extent of our invention which is to be measured only by the claims which follow.

We claim:

1. A method for forming multiple branch wells in the earth from a common main well hole comprising the steps of:

a. forming a main generally vertical hole in the earth;

b. inserting a casing into said main hole with the casing having at least two easily-penetrated section areas constituting windows at different vertical heights, said casing also having an internal indexing dog;

c. cementing said main casing in said main hole;

d. sequentially drilling each of the branch wells with at least two of said wells being drilled through said at least two windows through the lower window first as a drilling template engages the indexing dog to orient the drilling assembly;

e. inserting a multiple tube guide template with one branch casing for each of the branch holes into the main hole, said template engaging the indexing dog to orient the branch casings towards their respective branch holes; and f. inserting all of the branch casing into their respective branch holes at about the same time and cementing the same.

2. The method of claim 1 wherein the drilling template of step d, and the tube guide template may be individually rotated to engage the indexing dog protruding from the main casing.

3. The method of claim 2 also including the additional step g. of perforating the branch casings after step e. to allow a leachant solution to pass therethrough either to or from an ore zone.

4. The method of claim 3 wherein:

step a. is formed by drilling into the earth at least 1,000 feet above an ore zone;

and step d. takes place until each of the branch wells terminate at an ore zone.

5. The method of claim 1 wherein in step d. one of the branch wells is drilled in a generally vertical direction from the bottom of the main hole casing.

6. A multiple branch well system comprising:

a main generally vertical cased well extending into the earth, said casing having at least two separated windows in its side with one window being vertically higher than the other window, said casing also having an opened lower end and an internal indexing dog;

at least two cased branch well holes extending from said main well, at least one of which extends through each of the windows in the casing and one from the bottom end of the main casing;

means to engage said indexing dog for orienting the direction of the branch well holes which extend through the casing windows, said means including a large collar with a series of smaller collars corresponding to a branch well hole to be drilled; and means for guiding the placement of branch casings into the branch well holes, said mean engaging the indexing dog to orient one casing towards each of said branch well holes.

* * * * *